US007289642B2

(12) United States Patent
Chen

(10) Patent No.: US 7,289,642 B2
(45) Date of Patent: Oct. 30, 2007

(54) AUDIO SPEAKER

(76) Inventor: Ting-Pang Chen, No. 46, Lane 69, Sec. 2, Chienkuo S. Rd., Taipei (TW)

( * ) Notice: Subject to any disclaimer, the term of this patent is extended or adjusted under 35 U.S.C. 154(b) by 445 days.

(21) Appl. No.: 10/945,152

(22) Filed: Sep. 20, 2004

(65) Prior Publication Data

US 2006/0062419 A1 Mar. 23, 2006

(51) Int. Cl.
*H04R 25/00* (2006.01)

(52) U.S. Cl. ..... 381/396; 381/404; 381/409; 381/412

(58) Field of Classification Search ..... 381/396, 381/398, 400, 404, 407–410, 412
See application file for complete search history.

(56) References Cited

U.S. PATENT DOCUMENTS 6,940,991 B2 * 9/2005 Shingu ..... 381/404

* cited by examiner

*Primary Examiner*—Suhan Ni
(74) *Attorney, Agent, or Firm*—Jackson Walker, LLP

(57) ABSTRACT

An audio speaker has a T-yoke, a solenoid, a voice coil, a cone paper, a magnet, a gasket, a basket, a terminal, a damper and a wire. The T-yoke has a bottom disk and a pole formed on the bottom disk. The solenoid and the voice coil are mounted on the pole. The cone paper is mounted a top of the t-yoke. The gasket is mounted on a top surface of the magnet. The basket is mounted on the gasket around the cone paper. The damper is mounted between the voice coil and the basket. The wire is mounted on the damper and has a sealant. The sealant is mounted securely on the damper and securely seals the wire, and thereby prevents the wire from swaying to eliminate both interference with the acoustic waves and corrosion arising from being exposed to humidity in the air.

1 Claim, 3 Drawing Sheets

AUDIO SPEAKER

BACKGROUND OF THE INVENTION

1. Field of the Invention

The present invention relates to an audio speaker, and more particularly to an audio speaker that prevent noises that is resistant to moisture and noise interference.

2. Description of Related Art

A speaker is one of the primary components of a hi-fi system, audio, television or radio and converts electrical signals into acoustic waves.

With reference FIG. 3, a conventional speaker in accordance with the prior art comprises a T-yoke (60), a solenoid (61), a voice coil (62), a cone paper (63), a magnet (70), a gasket (71), a basket (72), a damper (73), a wire (74) and a terminal (75).

The T-yoke (60) has a bottom disk and a pole formed on a top surface of the bottom disk. The solenoid (61) is mounted slidably around the pole. The voice coil (62) is mounted on a top of the pole. The cone paper (63) is mounted around the voice coil (62). The magnet (70) is mounted securely on the top surface of the bottom disk and around the solenoid (61). The gasket (71) is mounted on a top surface of the magnet (70). The basket (72) is mounted on the gasket (71) and around the cone paper (63) and has an outer surface and a mounting bracket (721). The mounting bracket (721) is mounted on the outer surface of the basket (72). The damper (73) is mounted around the voice coil (62) and under the cone paper (63). The wire (74) has two ends mounted between the voice coil (62) and the terminal (75) mounted on the mounting bracket (721), and extends through the cone paper (63) and the basket (72).

The solenoid (61) allows a variable current originating from an amplifier (not shown) to pass through and thereby generates a variable magnetic force interfering with a magnetic force of the magnet (70) to cause a variable vibration of the solenoid (61). The variable vibration of the solenoid (61) causes the damper to vibrate and generate acoustic waves.

However, the body of the wire (74) is swayable other than its ends mounted between the voice coil (62) and the terminal (75) and easily interferes with the acoustic waves and thereby the acoustic waves are distorted by accompanying noise. In addition, the wire is exposed in the air and easily oxidizes or corrodes with exposure to humidity.

To overcome the shortcomings, the present invention provides an audio speaker to mitigate or obviate the aforementioned problems.

SUMMARY OF THE INVENTION

The main objective of the invention is to provide an audio speaker that is waterproofing and prevents noises when working.

An audio speaker has a T-yoke, a solenoid, a voice coil, a cone paper, a magnet, a gasket, a basket, a terminal, a damper and a wire.

The T-yoke has a bottom disk and a pole formed the bottom disk. The solenoid and the voice coil are mounted on the pole. The basket is mounted on the gasket and around the cone paper. The damper is mounted between the voice coil and the basket. The wire is mounted on the damper and has a sealant. The sealant is mounted securely on the damper and securely seals the wire.

Other objectives, advantages and novel features of the invention will become more apparent from the following detailed description when taken in conjunction with the accompanying drawings.

DETAILED DESCRIPTION OF PREFERRED EMBODIMENT

Figure 1:
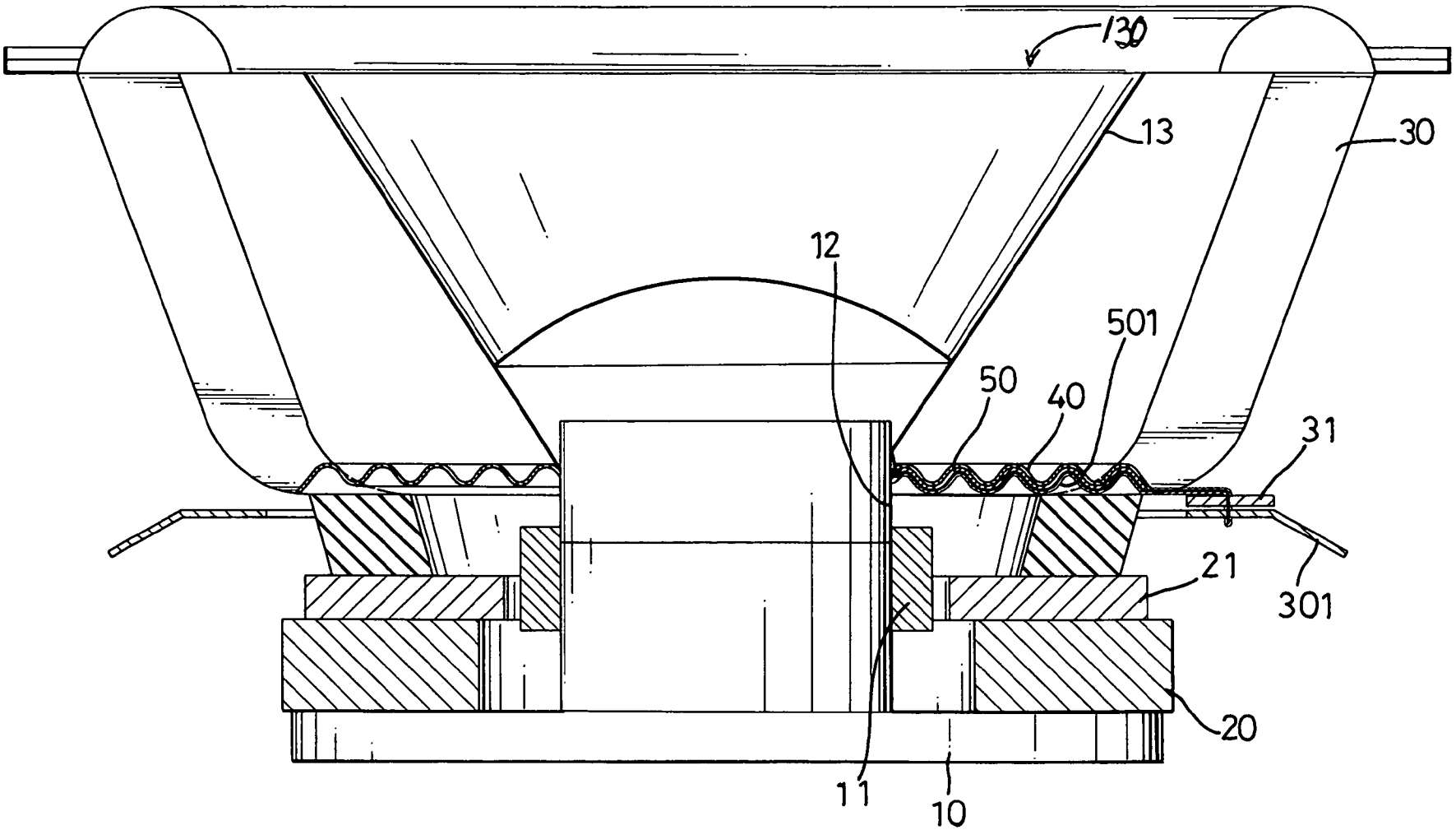
FIG. 1 is a side view in partial cross-section of an audio speaker in accordance with the present invention.
Figure 2:
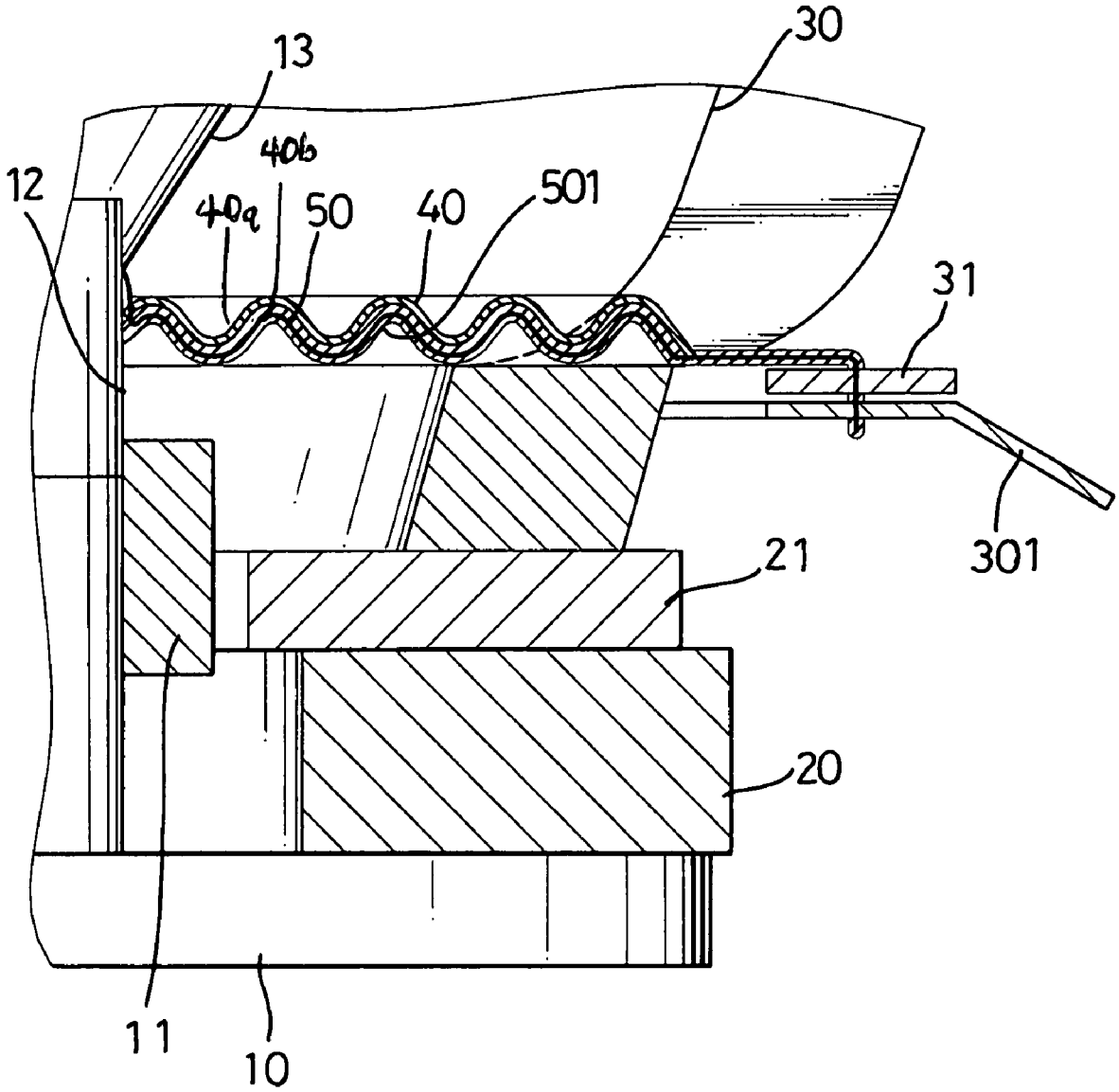
FIG. 2 is an enlarged side view in partial cross-section of the audio speaker in FIG. 1.
Figure 3:
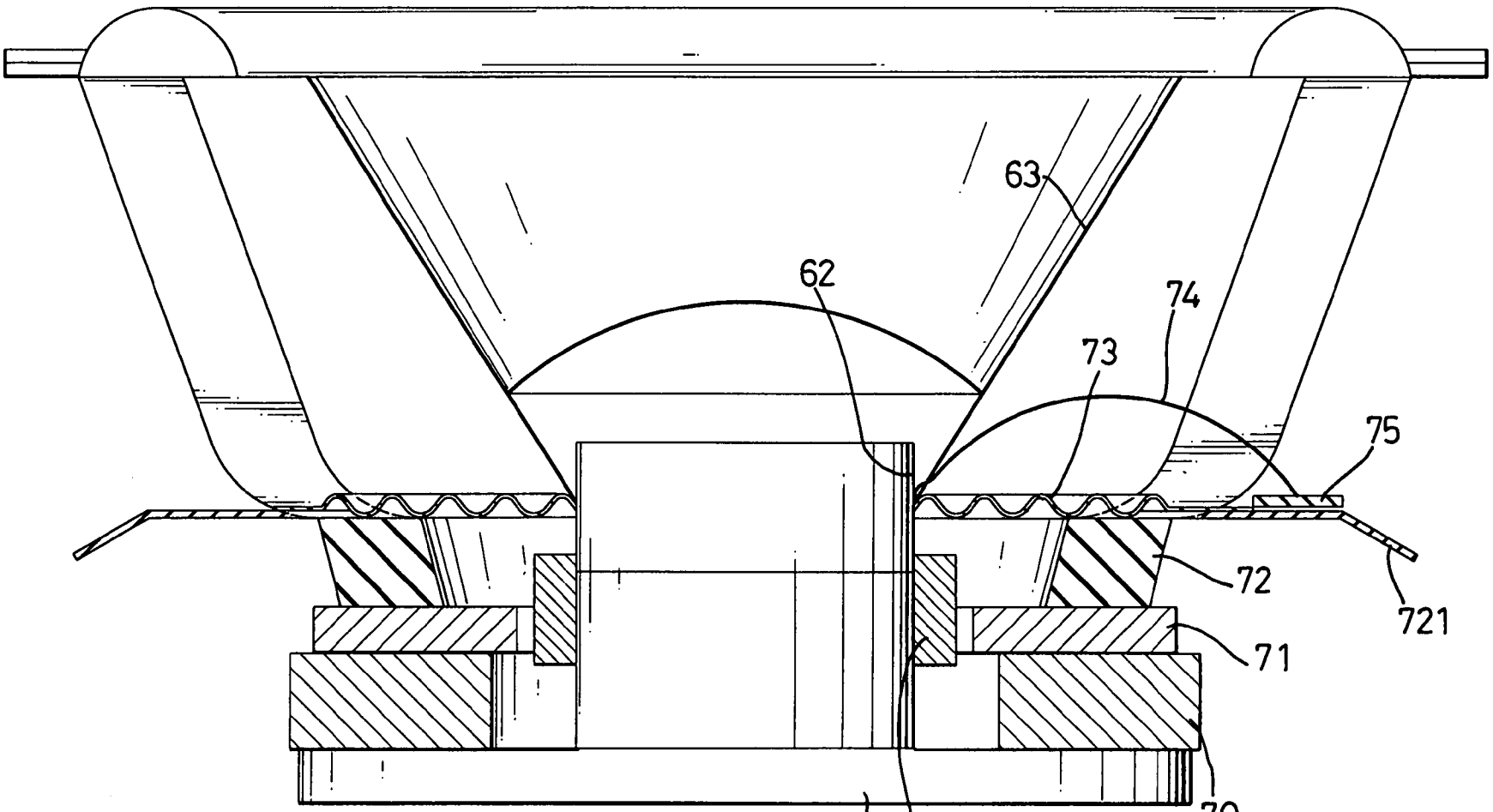
FIG.3 PRIOR ART
FIG. 3 is a side view in partial cross-section of a conventional speaker in accordance with the prior art.

With reference to FIG. 1, an audio speaker in accordance with the present invention comprises a T-yoke (10), a solenoid (11), a voice coil (12), a cone paper (13), a magnet (20), a gasket (21), a basket (30), a terminal (31), a damper (40) and a wire (50).

The T-yoke (10) has a bottom disk and a pole. The bottom disk has a top surface. The pole is formed on the top surface of the bottom disk and has a top.

The solenoid (11) is mounted slidably on the pole of the T-yoke (10). The voice coil (12) is mounted on the top of the pole. The cone paper (13) is mounted around the voice coil (12) and above the solenoid (11) and has an enlarged opening (130) allowing sound generated by the audio speaker to go out of the enlarged opening.

The magnet (20) is mounted securely on the top surface of the bottom disk and around the pole of the T-yoke (10) and has a top surface. The gasket (21) is mounted securely on the top surface of the magnet (20) and has a top surface. The basket (30) is mounted on the top surface of the gasket (21) and around the cone paper (13) and has an outer surface and a mounting bracket (301). The mounting bracket (301) is mounted on the outer surface of the basket (30). The terminal (31) is mounted on the mounting bracket (301). The damper (40) is annular, mounted between the voice coil (12) and the basket (30) and has a wave-shaped cross-section, an outside surface (40*a*) and an inside surface (40*b*). The outside surface (40*a*) faces the enlarged opening (130) of the cone paper (30). The inside surface (40*b*) is opposite to the outside surface (40*a*) and faces the solenoid (11) and the magnet (20).

The wire (50) is mounted on the inside surface (40*b*) of the damper (40) along the wave-shaped cross-section with glue sealing the wire (50), extends through the basket (30) and has a body, two ends and a sealant (501). The body of the wire (50) is mounted on the damper (40) along the wave-shaped cross-section. The ends of the wire (50) are connected respectively to the voice coil (12) and the terminal (31). The sealant (501) is mounted securely on the inside surface (40*b*) of the damper (40) and seals the wire (50), and thereby the wire (50) is mounted firmly on the damper (40).

The sealant (501) securely seals the wire (50) and prevents the wire (50) both from swaying such that interference to the acoustic waves is eliminated, and from being exposed to humidity in the air. Therefore, the audio speaker in accordance with the present invention has a good durability.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An audio speaker comprising:

a T-yoke having:

a bottom disk having a top surface; and a pole formed on the top surface of the bottom disk and having a top;

a solenoid mounted slidably on the pole of the T-yoke;

a voice coil mounted on the top of the pole;

a cone paper mounted around the voice coil and above the solenoid and having an enlarged opening adapted to allow sound generated by the audio speaker to go out of the enlarged opening;

a magnet mounted securely on the top surface of the bottom disk and around the pole of the T-yoke and having a top surface;

a gasket mounted securely on the top surface of the magnet and having a top surface;

a basket mounted on the top surface of the gasket and around the cone paper and having an outer surface; and a mounting bracket mounted on the outer surface of the basket;

a terminal mounted on the mounting bracket;

a damper mounted between the voice coil and the basket and having a wave-shaped cross-section;

an outside surface facing the enlarged opening of the cone paper; and an inside surface being opposite to the outside surface and facing the solenoid and the magnet; and a wire mounted on the inside surface of the damper along the wave-shaped cross-section with glue sealing the wire, extending through the basket and having a body mounted on the damper along the wave-shaped cross-section;

two ends connected respectively to the voice coil and the terminal mounted on the mounting bracket; and a sealant mounted securely on the inside surface of the damper and sealing the wire.

* * * * *